US010265747B2

(12) United States Patent
Yu et al.

(10) Patent No.: US 10,265,747 B2
(45) Date of Patent: Apr. 23, 2019

(54) ROTARY EXTRUSION PRODUCING MOLD FOR PRODUCING INNER RING RIB WITH LARGE ASPECT RATIO FORMED OF HOLLOW BILLET

(71) Applicant: North University of China, Shanxi (CN)

(72) Inventors: Jianmin Yu, Shanxi (CN); Zhimin Zhang, Shanxi (CN); Xubin Li, Shanxi (CN); Qiang Wang, Shanxi (CN); Mo Meng, Shanxi (CN)

(73) Assignee: NORTH UNIVERSITY OF CHINA, Shanxi (CN)

( * ) Notice: Subject to any disclaimer, the term of this patent is extended or adjusted under 35 U.S.C. 154(b) by 43 days.

(21) Appl. No.: 15/468,743

(22) Filed: Mar. 24, 2017

(65) Prior Publication Data

US 2018/0056353 A1 Mar. 1, 2018

(30) Foreign Application Priority Data

Sep. 1, 2016 (CN) ..... 2016 1 0837484

(51) Int. Cl.
*B21C 25/08* (2006.01)
*B21C 23/20* (2006.01)
(Continued)

(52) U.S. Cl.
CPC ..... *B21C 25/08* (2013.01); *B21C 23/20* (2013.01); *B21C 25/02* (2013.01); *B21C 25/04* (2013.01)

(58) Field of Classification Search
CPC ..... B21C 23/20; B21C 23/205; B21C 25/02; B21C 25/08; B21C 23/085
See application file for complete search history.

(56) References Cited

U.S. PATENT DOCUMENTS 6,192,730 B1 2/2001 Ames et al.

FOREIGN PATENT DOCUMENTS

CN 103341513 10/2013
CN 103567249 2/2014
(Continued)

OTHER PUBLICATIONS

Notification to Grant for Application No. 201610837484.4 filed on Sep. 1, 2016.

(Continued)

*Primary Examiner* — Debra M Sullivan
(74) *Attorney, Agent, or Firm* — Miller, Matthias & Hull LLP

(57) ABSTRACT

The present invention discloses a rotary extrusion producing mold for producing an inner ring rib with a large aspect ratio formed of a hollow billet, which consists of a concave die, a left half convex die, a right half convex die, a mandrel, a lower core support and an elastic supporting mechanism, the left and right half convex dies are fixed onto an upper template connected with a slider and a horizontal hydraulic cylinder, a left drive hydraulic cylinder and a right drive hydraulic cylinder are mounted at both ends of the upper template, respectively, the lower core support passes through a middle of the concave die, the elastic supporting mechanism is mounted at a bottom of the lower core support, a drive gear is mounted on a side face of the concave die, and the mandrel is disposed between the left and right half convex dies.

1 Claim, 2 Drawing Sheets

(51) Int. Cl.
*B21C 25/02* (2006.01)
*B21C 25/04* (2006.01)

(56) References Cited

FOREIGN PATENT DOCUMENTS

| | | | | |
|---|---|---|---|---|
| CN | 103878199 | | 6/2014 | |
| CN | 10439771 A | * | 3/2015 | ..... B21C 25/02 |
| CN | 104399771 | | 3/2015 | |

OTHER PUBLICATIONS

Chinese Office Action for Application No. 201610837484.4 filed on Sep. 1, 2016.
Chinese Search Report for Application No. 201610837484.4 filed on Sep. 1, 2016.

* cited by examiner

ROTARY EXTRUSION PRODUCING MOLD FOR PRODUCING INNER RING RIB WITH LARGE ASPECT RATIO FORMED OF HOLLOW BILLET

CROSS-REFERENCE TO RELATED APPLICATION

This application claims priority under 35 U.S.C. § 119 and the Paris Convention to Chinese Patent Application No. 201610837484.4 filed on Sep. 1, 2016.

FIELD OF THE DISCLOSURE

The present invention relates to the technical field of molds, and more particularly to a rotary extrusion producing mold for producing an inner ring rib with a large aspect ratio by a hollow billet.

BACKGROUND ART OF THE DISCLOSURE

At present, many thin-walled rotational parts are of a structure with an integrally machined inner reinforcement rib, in order to reduce the weight, improve the effective load, and increase the strength thereof. Spinning process is widely used for forming parts with inner ribs, but it has a serious difficulty in forming ribs with a large aspect ratio. Especially for magnesium alloy materials with low plastic formability, ribs formed therefrom usually have a quality that cannot meet the requirements as they are prone to defects such as cracks, ripples, accumulation and fracture. The spinning process used currently does not well adapt to the magnesium alloys.

A fine-grained structure may be obtained through plastic deformation, which can also improve the strength and toughness of parts, thereby producing a good fine-grain strengthening effect. However, the traditional metal plastic processing methods, such as forging, extrusion and torsion, each produce a small plastic strain which is generally less than 2.5. If the number of forming passes is increased so that the corresponding plastic strain reaches 2.5 or more, the thickness and diameter of the processed material will become very small, which makes the material not suitable for forming structural parts in most cases. Studies show that micron and submicron grains can be obtained only under a true strain reaching at least 4.0 or more, so as to exhibit an excellent fine-grain strengthening effect. At present, some new SPD plastic processing technologies, such as ECAP (Equal Channel Angular extrusion), TE (torsion extrusion), HPT (high-pressure torsion) and CEC (cyclic extrusion compression), each enable the materials to obtain larger plastic strains, and they are thus effective ways to refine grains. However, these new technologies face severe challenges in the uniformity of forming. For example, in case of forming by high-pressure torsion, the strain at the center of a billet is much smaller than the strain at the edge portion of the billet, and the grain size of a microstructure at the center portion is also more than 2 times larger than that at the edge portion, that is, there is an extremely uneven deformation in the deformation section.

SUMMARY OF THE DISCLOSURE

In view of the deficiencies and shortcomings of the prior art, an object of the present invention is to provide a rotary extrusion producing mold for producing an inner ring rib with a large aspect ratio formed of a hollow billet and a method of operating the same.

To solve the problems described in the background art, a rotary extrusion producing mold for producing an inner annular rib with a large aspect ratio formed of a hollow billet according to the present invention consists of a concave die, a left half convex die, a right half convex die, a mandrel, a lower core support and an elastic supporting mechanism, the left half convex die and the right half convex die are fixed onto an upper template connected with a slider and a horizontal hydraulic cylinder, a left drive hydraulic cylinder and a right drive hydraulic cylinder are mounted at both ends of the upper template, respectively, the lower core support passes through a middle of the concave die, the elastic supporting mechanism is mounted at a bottom of the lower core support, a drive gear is mounted on a side face of the concave die, and the mandrel is disposed between the left half convex die and the right half convex die.

The present invention has the following beneficial effects: deformation is prevented during the extrusion process, by means of the lower core support at the middle of the hollow billet; the concave die is rotatable, and the convex dies, which are separable from each other, allow not only downward extrusion but also transverse extrusion; and it is convenient to use and simple to operate. In addition, with the lower core support disposed at the middle of the hollow billet, after the two half convex dies are separated in the radial direction from each other, it is able to effectively avoid burrs from being generated along a gap created due to the separation of the two half convex dies, which would otherwise affects the quality of the part formed by the rotary extrusion.

DESCRIPTION OF REFERENCE NUMBERS

1—concave die; 2—lower core support; 3—elastic supporting mechanism; 4—left half convex die; 5—right half convex die; 6—left drive hydraulic cylinder; 7—right drive hydraulic cylinder; 8—drive gear; 9—blank; 10—mandrel; and 11—processed pit.

DETAILED DESCRIPTION OF THE DISCLOSURE

The present invention will be further described below in conjunction with the drawings.

For making the objects, technical solutions and advantages of the present invention more clear and apparent, the present invention will be further described below in detail in conjunction with the drawings and particular embodiments. It should be understood that the particular embodiments described herein are merely intended to explain the present invention rather than limiting the present invention.

Figure 1:
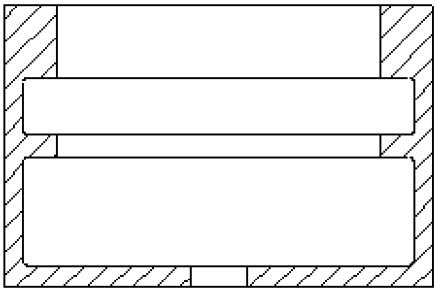
FIG. 1 is a view of an extruded part according to the present invention.
Figure 2:
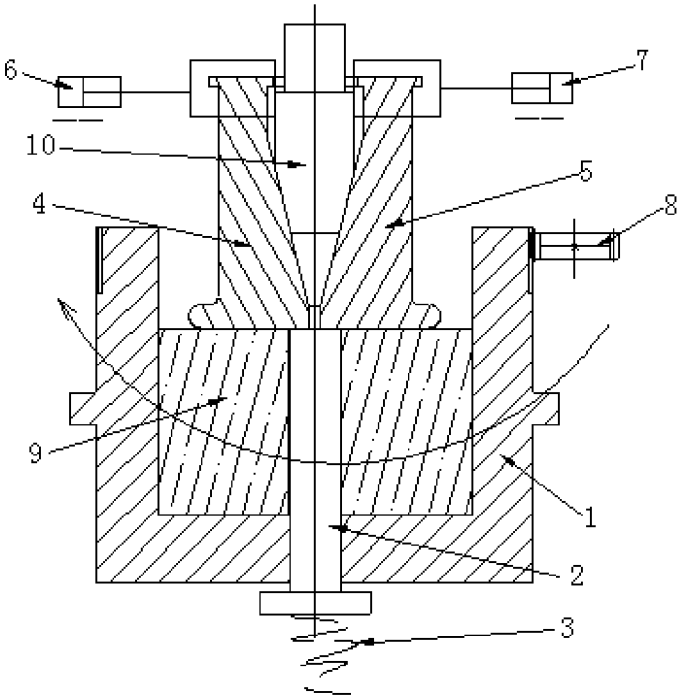
FIG. 2 is a schematic view showing the principle of rotary extrusion forming according to the present invention.
Figure 3:
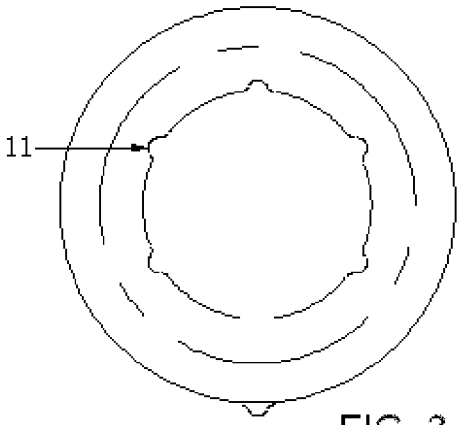
FIG. 3 is a schematic structural view of an inner cavity of a concave die according to the present invention.
Figure 4:
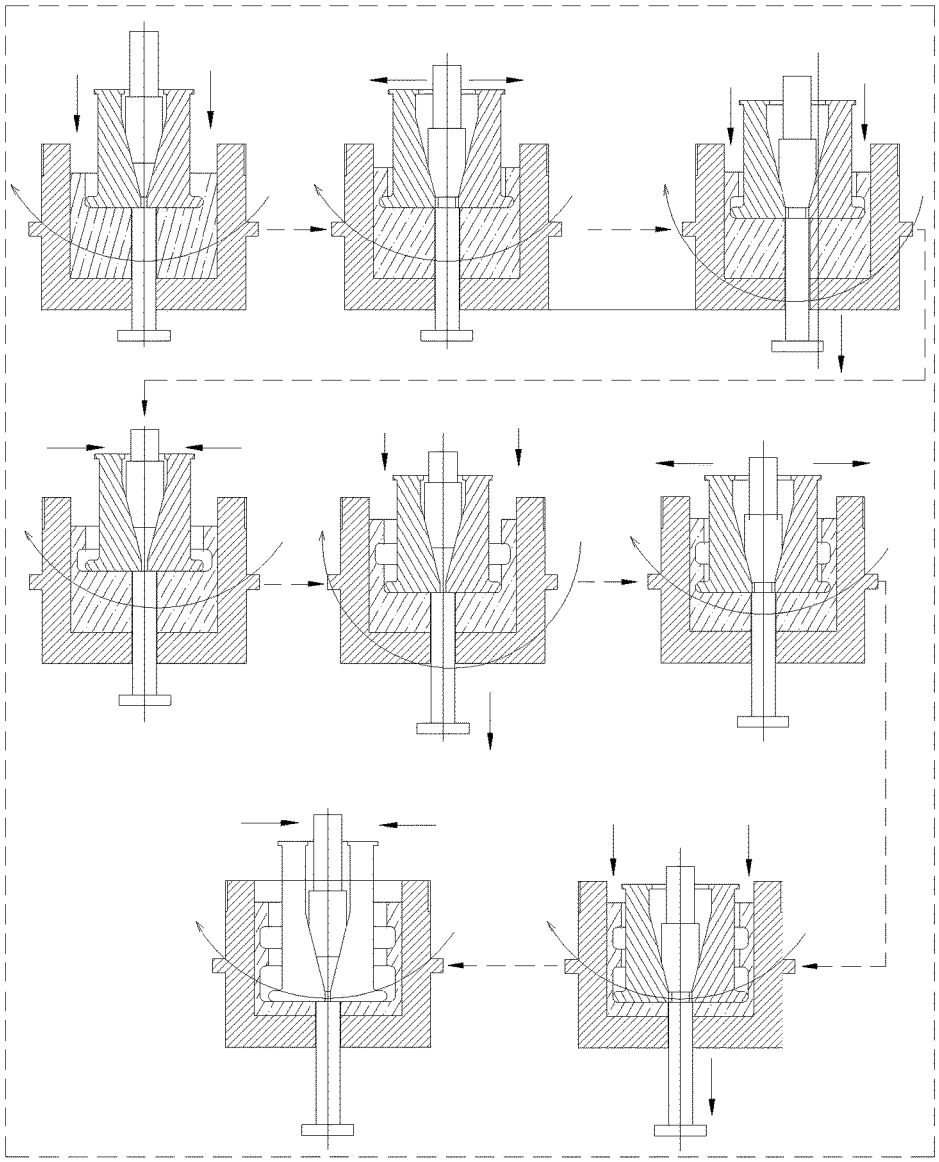
FIG. 4 is a schematic view showing a process for forming a transverse rib according to the present invention.

As shown in FIGS. 1 to 4, the particular embodiment adopts technical solutions as follows. A rotary extrusion producing mold for producing an inner ring rib with a large aspect ratio formed of a hollow billet, which is an involute forming combined mold for forming a magnesium alloy shell-like part with a ring rib, consists of a concave die 1, a left half convex die 4, a right half convex die 5, a mandrel 10, a lower core support 2 and an elastic supporting mechanism 3. The left half convex die 4 and the right half convex die 5 are fixed onto an upper template connected with a slider and a horizontal hydraulic cylinder. A left drive hydraulic cylinder 6 and a right drive hydraulic cylinder 7 are mounted at both ends of the upper template, respectively. The lower core support 2 passes through a middle of the concave die 1. The elastic supporting mechanism 3 is mounted at a bottom of the lower core support 2. A drive gear 8 is mounted on a side face of the concave die 1. The mandrel 10 is disposed between the left half convex die 4 and the right half convex die 5.

A method of operating the rotary extrusion producing mold for producing an inner ring rib with a large aspect ratio formed of a hollow billet includes: combining, at an initial stage of rotary extrusion, the two convex dies together and driving, by the slider on a press machine, the left half convex die and the right half convex die to extrude a blank 9 downward so as to form an initial profile of a transverse rib; dragging respectively, by the left and right horizontal hydraulic cylinders, the left half convex die 4 and the right half convex die 5 to move in a radial direction, to form an initial cylindrical wall, so as to achieve a purpose of forming the transverse rib, once the left half convex die 4 and the right half convex die 5, which are in bilateral symmetry, have extruded the blank downward by a certain depth; where a head of the mandrel is set to be at a certain conical degree which enables a vertical force loaded vertically by a main hydraulic cylinder to be converted into a forming force loaded horizontally, to achieve a radial flow of metal during the formation of the transverse rib; a certain number of processed pits 11 are distributed on an inner cavity of the concave die, and a torque applied by a lower rotary table to the concave die is transmitted via the processed pits to the billet to cause a rotational movement of the billet; the billet is always rotated at a set speed during all the above steps; the lower core support 2 is provided to have a diameter same as that of an inner hole of the hollow billet, and to take a reciprocating motion in the axial direction; and a speed of the movement of the lower core support is set to be the same as a speed at which the two half convex dies are vertically loaded, so that after the two half convex dies are separated in the radial direction from each other, the billet can be ensured to always flow towards a wall portion in the radial direction without entering a gap created due to the separation of the convex dies. Parts with different bottom holes can be formed, if the core support is provided with different diameters.

In the present particular embodiment, a hollow billet is adopted to reduce strain gradient from the center portion to the edge portion during deformation; furthermore, when the two separate convex dies are rotated while extruding in the axial direction, a torsional shearing stress is applied to the bottom metal to increase the uniformity of the strains of the bottom metal. Then, the billet fits with the concave die by a certain positioning structure, so that the billet is driven to be rotated with the rotation of the concave die; and furthermore, the radial feeding of the two separate convex dies enables the rotary extrusion forming of the inner ring rib by the hollow billet. Since the shell part is rotated while being axially extruded during its formation, the fiber directions of the inner metal of the cylindrical wall are arranged in the form of an inner spiral, which greatly reduces deformation textures, and also improves the uniformity of the strains of the metal at the wall portion, thereby improving comprehensive mechanical properties of the component.

The foregoing is only intended to illustrate the technical solutions of the present invention rather than limiting. Any other modifications or equivalent alternatives made by those skilled in the art to the technical solutions of the present invention should be embraced in the scope of the claims of the present invention, if not departing from the spirit and scope of the technical solutions of the present invention.

The invention claimed is:

1. A rotary extrusion producing mold for producing an inner ring rib with a large aspect ratio formed of a hollow billet, wherein the mold consists of a concave die, a left half convex die, a right half convex die, a mandrel, a lower core support and an elastic supporting mechanism, the left half convex die and the right half convex die are fixed onto an upper template connected with a slider and a horizontal left drive hydraulic cylinder and a horizontal right drive hydraulic cylinder, the left drive hydraulic cylinder and the right drive hydraulic cylinder are mounted at both ends of the upper template, respectively, the lower core support passes through a middle of the concave die, the elastic supporting mechanism is mounted at a bottom of the lower core support, the lower core support is provided to have a diameter same as that of an inner hole of the hollow billet, and to take a reciprocating motion in the axial direction; and a speed of the movement of the lower core support is set to be the same as a speed at which the two half convex dies are vertically loaded, a drive gear is mounted on a side face of the concave die, and the mandrel is disposed between the left half convex die and the right half convex die.

* * * * *